US007645309B2

(12) United States Patent
Jeong et al.

(10) Patent No.: US 7,645,309 B2
(45) Date of Patent: Jan. 12, 2010

(54) DUST COLLECTION UNIT AND VACUUM CLEANER WITH THE SAME

(75) Inventors: Hoi Kil Jeong, Changwon-si (KR); Man Tac Hwang, Changwon-si (KR); Young Ho Kim, Changwon-si (KR); Jung Bae Hwang, Daegu (KR); Min Park, Busan (KR)

(73) Assignee: LG Electronics Inc., Seoul (KR)

( * ) Notice: Subject to any disclaimer, the term of this patent is extended or adjusted under 35 U.S.C. 154(b) by 510 days.

(21) Appl. No.: 11/233,004

(22) Filed: Sep. 23, 2005

(65) Prior Publication Data

US 2006/0137309 A1 Jun. 29, 2006

(30) Foreign Application Priority Data

Dec. 27, 2004 (KR) ..... 10-2004-0113370
Dec. 27, 2004 (KR) ..... 10-2004-0113378

(51) Int. Cl.
*B01D 45/12* (2006.01)

(52) U.S. Cl. ..... 55/337; 55/424; 55/426; 55/429; 55/459.1; 55/DIG. 3

(58) Field of Classification Search ..... 55/337, 55/345, 424, 426, 429, 459.1, DIG. 3; 15/350, 15/353

See application file for complete search history.

(56) References Cited

U.S. PATENT DOCUMENTS

| | | | | |
|---|---|---|---|---|
| 4,853,008 | A | 8/1989 | Dyson | |
| 6,558,453 | B2 * | 5/2003 | Sepke et al. | 95/268 |
| 7,022,154 | B2 * | 4/2006 | Oh | 55/426 |
| 7,261,754 | B2 * | 8/2007 | Oh et al. | 55/343 |
| 2002/0194993 | A1 | 12/2002 | Gen | |
| 2004/0103495 | A1 | 6/2004 | Oh | |

* cited by examiner

*Primary Examiner*—Robert A Hopkins
(74) *Attorney, Agent, or Firm*—McKenna Long & Aldridge LLP

(57) ABSTRACT

A dust collection unit for a vacuum cleaner includes a first filtering chamber filtering foreign objects using a cyclone airflow, a separation plate defining a top surface of the first filtering chamber, a filter having a diameter that is reduced as it goes downward in response to airflow rate variation in the first filtering chamber, and a blocking member provided under the filter to prevent the foreign objects filtered in the first filtering chamber from flying.

18 Claims, 9 Drawing Sheets

DUST COLLECTION UNIT AND VACUUM CLEANER WITH THE SAME

BACKGROUND OF THE INVENTION

1. Field of the Invention

The present invention relates to a vacuum cleaner, and particularly, to a dust collection unit for a vacuum cleaner, which can improve the dust collection efficiency. More particularly, the present invention relates to a dust collection unit for a vacuum cleaner, which can improve the foreign object filtering efficiency by providing a filter assembly in a filtering chamber in which a cyclone airflow is generated and can make it easy to clean the filter assembly by designing the filter assembly to be separated into a plurality of parts.

2. Description of the Related Art

A vacuum cleaner is used to clean a room or other spaces by sucking air containing foreign objects and filtering the foreign object using vacuum pressure generated therein. In order to filter the foreign objects contained in the sucked air, a dust collection unit with a filtering unit is provided in the vacuum cleaner.

The filtering unit is classified into a porous filter formed of porous material and a cyclone type filter. The porous filter formed of porous material is designed to filter the foreign objects contained in air while the air passes through the filter. The cyclone type filter is designed to filter the foreign objects using cyclone airflow. In order to reuse the porous filter, a user cleans the filter to remove the foreign objects clogged in the filter. It is very inconvenient to clean the filter. Furthermore, when a large amount of the foreign objects are clogged, the porous filter cannot be reused. Since the cyclone type filter is designed to remove the foreign objects from the air by a rotational air current generated by cyclone airflow, the clogging of the foreign objects in the filter is not incurred. Due to this reason, in recent years, cyclone type filter has been widely used.

In recent years, a multi-cyclone type dust collection unit, in which the cyclone unit is provided in plurality to generate a plurality of cyclone airflows so that the foreign objects contained in the air can be filtered by only the cyclone airflows, has been developed. The multi-cyclone airflows improve the foreign object removal efficiency. In addition, since there is no need to additionally provide the porous filter in the dust collection unit, the clogging problem is not incurred.

However, the multi-cyclone type dust collection unit is designed to remove the foreign objects using only the cyclone airflows, the foreign object removable efficiency is still insufficient. Therefore, there is a pressing need to improve the foreign objects removal efficiency in the multi-cyclone type dust collection unit.

In addition, when the foreign objects such as hairs are accumulated in an inner chamber of the multi-cyclone dust collection unit, the user must remove the foreign objects using his/her hands. This is troublesome for the user.

SUMMARY OF THE INVENTION

Accordingly, the present invention is directed to a dust collection unit for a vacuum cleaner that substantially obviates one or more problems due to limitations and disadvantages of the related art.

An object of the present invention is to provide a dust collection unit and a vacuum cleaner with the same, which can improve the dust removal efficiency using cyclone airflow.

Another object of the present invention is to provide a dust collection unit and a vacuum cleaner with the same, which can keep a filtering chamber, in which cyclone airflow is generated, clean by providing a filter designed in response to RPM of rotational current generated by the cyclone airflow.

Still another object of the present invention is to provide a dust collection unit and a vacuum cleaner with the same, which can be conveniently cleaned by a user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit for a vacuum cleaner, including: a first filtering chamber filtering foreign objects using a cyclone airflow; a separation plate defining a top surface of the first filtering chamber; a filter having a diameter that is reduced as it goes downward in response to airflow rate variation in the first filtering chamber; and a blocking member provided under the filter to prevent the foreign objects filtered in the first filtering chamber from flying.

In another aspect of the present invention, there is provided a vacuum cleaner including: a base; a dust collection unit disposed on a front portion of the base; a motor disposed on a rear portion of the base; and a cover disposed above the base, wherein the dust collection unit includes: a first filtering chamber having a relatively large diameter; a plurality of second filtering chambers formed on an outer circumference of the first filtering chamber; storing chambers formed under the first and second filtering chambers; a filter detachably mounted on a center portion of the first filtering chamber, the filter being formed of a rigid plastic material; a blocking member detachably mounted on the filter, the blocking member having a diameter that is reduced as it goes downward; and a plurality of airflow preventing plates disposed in a radial direction and integrally formed with a bottom surface of the blocking member.

In still another aspect of the present invention, there is provided a vacuum cleaner including: a base; a dust collection unit disposed on a front portion of the base; a motor disposed on a rear portion of the base; a cover disposed above the base; and a front support fixing the base and the cover at a front portion, wherein the dust collection unit includes: a first filtering chamber formed on a center portion of the dust collection unit and having a relatively large diameter; a plurality of second filtering chambers formed on an outer circumference of the first filtering chamber; a filter detachably mounted on a center portion of the first filtering chamber, the filter being formed of a rigid plastic material; a blocking member detachably mounted on the filter, the blocking member having a diameter that is reduced as it goes downward; and a plurality of airflow preventing plates disposed in a radial direction and integrally formed with a bottom surface of the blocking member.

In still yet another aspect of the present invention, there is provided a vacuum cleaner including: a motor generating sucking force; a dust collection unit filtering foreign objects contained in air introduced by the sucking force generated by the motor; and a suction assembly guiding outer air to the dust collection unit, wherein the dust collection unit includes: a first filtering chamber formed on a center portion of the dust collection unit and having a relatively large diameter; a plurality of second filtering chambers formed on an outer circumference of the first filtering chamber; a cone-shaped filter mounted on a center portion of the first filtering chamber; a blocking member detachably mounted on the cone-shaped filter to prevent the foreign objects from flying; and an airflow preventing plate integrally formed with the blocking member to stop the cyclone airflow.

According to the present invention, the inventive dust collection unit can improve the foreign object removal efficiency. In addition, the inventive dust collection unit is designed to easily remove the foreign objects accumulated therein, thereby providing the convenience in use to a user and increasing the service lift thereof.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
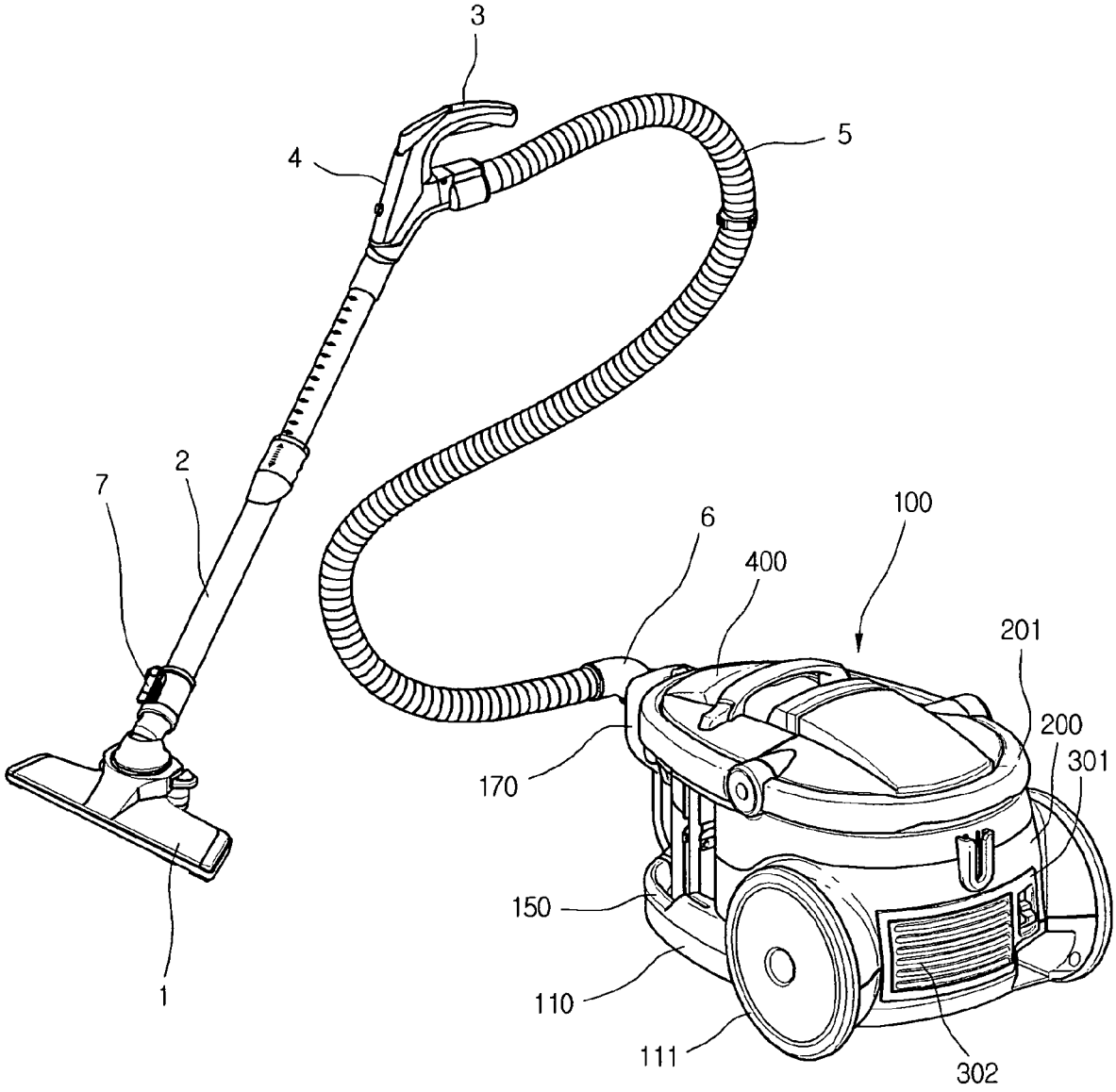
FIG. 1 is a perspective view of a vacuum cleaner according to an embodiment of the present invention.

FIG. 1 shows a vacuum cleaner to which a dust collection unit according to the present invention can be applied.

Referring to FIG. 1, a vacuum cleaner includes a main body 100 and a suction assembly connected to a suction portion through which outer air is sucked into the main body 100. Disposed in the main body 100 are a motor (not shown), a suction fan (not shown), and a dust collection unit (not shown). Therefore, the sucked air is exhausted out of the main body 100 after foreign objects contained in the sucked air are filtered.

The suction assembly is provided to suck the air containing the foreign objects when sucking force is generated in the main body 100. That is, the suction assembly includes a sucking nozzle body 1 for sucking the air containing the foreign objects using a powerful airflow, an expandable tube 2 extending from the sucking nozzle body 1 and expandable and contractible by a user, an operation handle 3 provided on a distal end of the expandable tube 2, a manipulation unit 4 provided on a front portion of the operation handle 3, a flexible tube 5 extending from the operation handle 2, a connector 6 connecting a distal end of the flexible tube 5 to the main body 100, a pipe rest 7 on which the expandable pipe 2 can be supported and suspended when the vacuum cleaner is not used.

The connector 6 functions as a connection terminal transmitting a manipulation signal inputted by the user through the manipulation unit 4 to the main body 100 as well as a passage through which the sucked air is introduced into the main body 100. That is, a plurality of electric connection terminals are provided on a proximal end of the connector 6. However, the electric connection terminals are required only when the manipulation unit 4 is provided on the suction assembly. That is, when the manipulation unit 4 is provided on the main body 100, the electric connection terminals are not provided on the connector 6. In this case, the connector 6 may simply function as an air introducing passage.

The air introduced into the main body 100 through the suction assembly is exhausted out of the main body 100 after the foreign objects contained in the introduced air are filtered. The main body 100 of the vacuum cleaner will be described in more detail hereinafter with reference to FIGS. 1 and 2.

Figure 2:
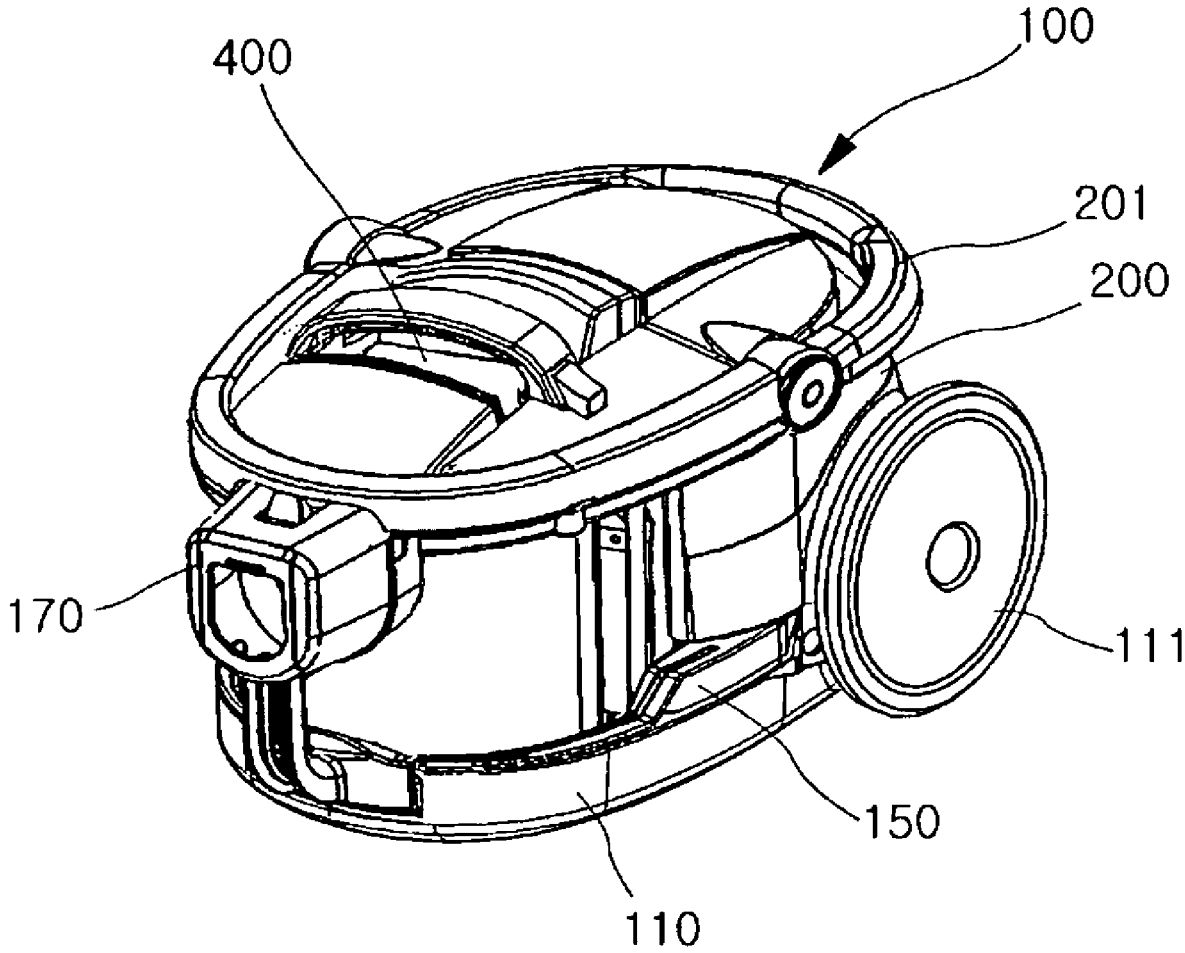
FIG. 2 is a front perspective view of a vacuum cleaner depicted in FIG. 1.

FIG. 2 shows the main body of the vacuum cleaner.

Referring to FIGS. 1 and 2, the main body 100 includes a first base 110 defining a lower portion of the main body 100, a second base 150 disposed on the first base 110, a cover 200 disposed on the second base 150, wheels 111 provided on both rear-side portions of the cover 200 to make it easy to move the main body 100, and a front support 70 for supportably fixing the cover 200 and the first and second bases 110 and 150.

The connector 6 is connected to the front support 170 to allow the outer air to be introduced into the main body 100. The support 170 is designed to support the cover 200 and the first and second bases 110 and 150, thereby securely supporting the front portion of the main body 100.

The second base 150 is provided right above the first base 110 to improve the ornament of the main body and enhance the rigidity of the lower portion of the main body.

An exhaust cover 301 provided with a plurality of exhaust holes 302 is provided on a rear portion of the cover 200 to exhaust clean air. A carrying handle 201 is pivotally provided on a top surface of the cover 200. When a user intends to carry the main body 100, the user pivots the carrying handle 201 in a vertical position and conveniently carries the main body 100 with his/her hand grasping the carrying handle 201.

A dust collection unit 400 is disposed in the main body in rear of the front support 170 and a cyclone member (not shown) is received in the dust collection unit to generate cyclone airflows and filter the foreign object contained in the air.

Figure 3:
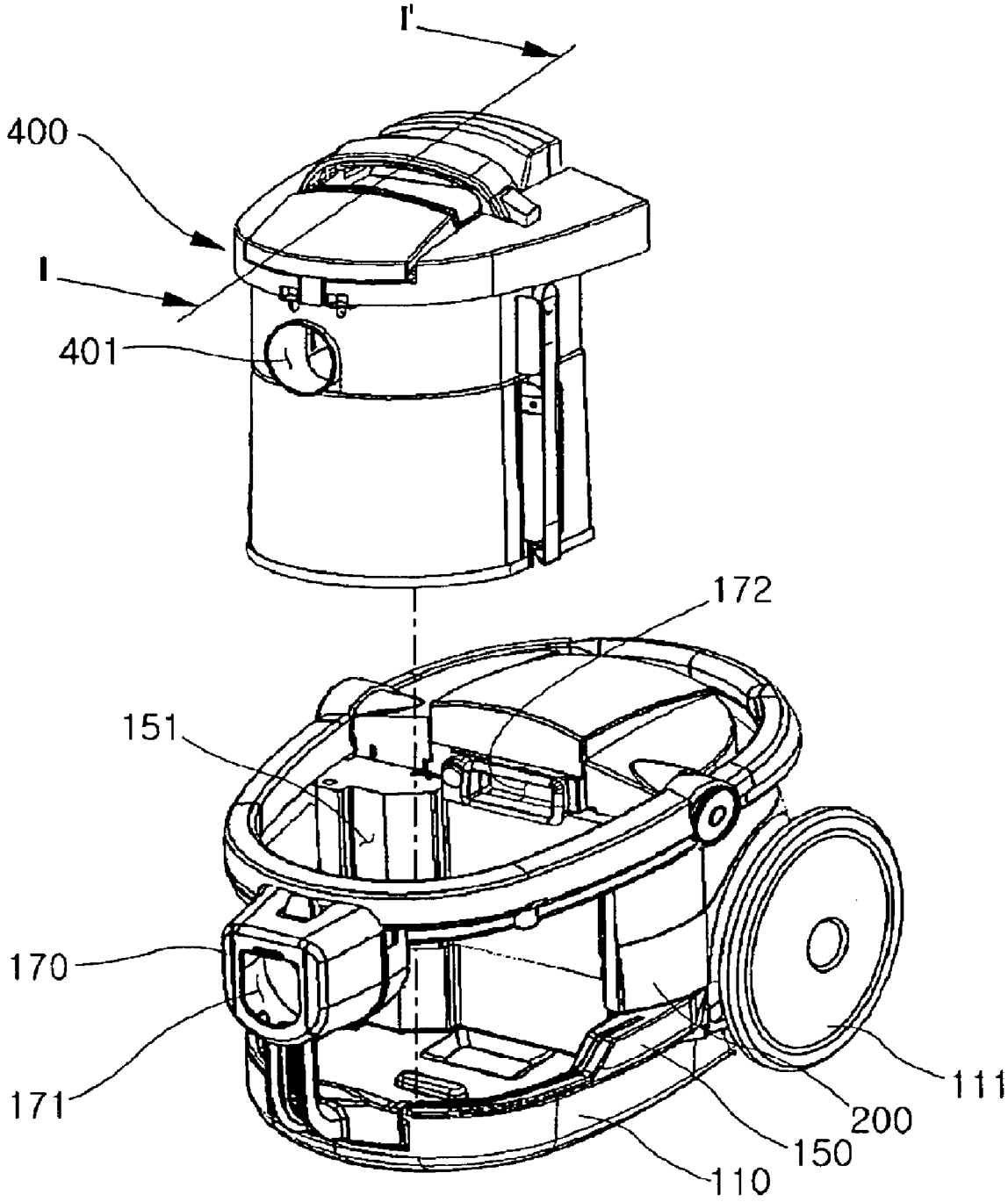
FIG. 3 is a perspective view illustrating a mounting process of a collection unit.

As shown in FIG. 3, the dust collection unit 400 is vertically installed in and separated from a receiving chamber 151 defined in the main body 100. That is, the dust collection unit 400 may be installed in the receiving chamber 151 by being pushed downward and separated from the receiving chamber 151 by being pulled upward.

The front support 170 is provided with a first air intake hole 171 and the dust collection unit 400 is provided with a second air intake hole 401 corresponding to the first air intake hole 171. The dust collection nit 400 is further provided with an exhaust hole (not shown) opposite to the second air intake hole 401. The exhaust hole is aligned with a third air intake hole 172 formed toward the motor so that the air cleaned by passing through the collection unit 400 is exhausted toward the motor side.

Particularly, the third air intake hole 172 is formed in a rectangular shape lengthwise in a horizontal direction so as to reduce the size of the main body 100 and allow the air to effectively flow.

Figure 4:
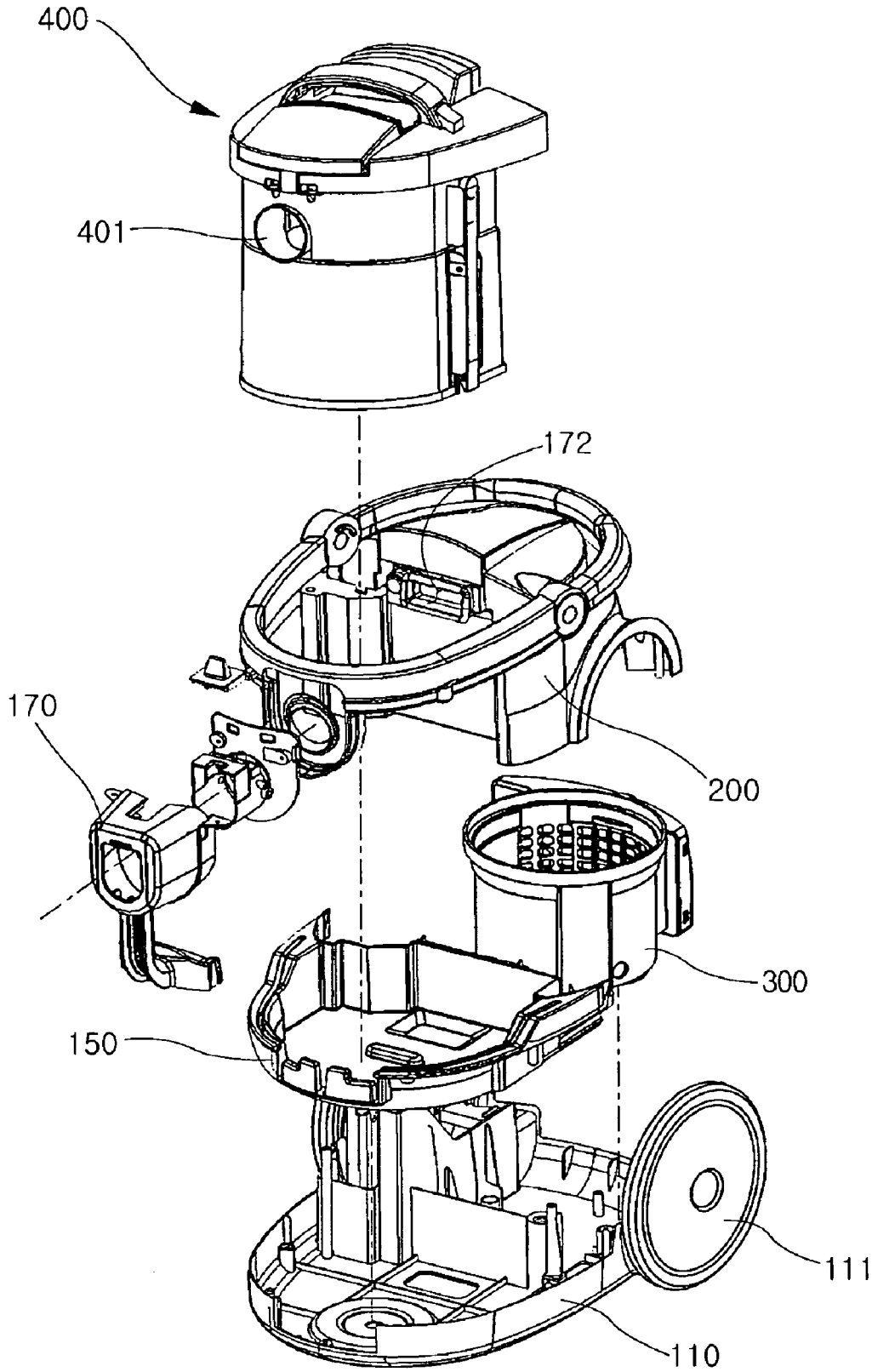
FIG. 4 is an exploded perspective view of a main body of a vacuum cleaner according to one embodiment of the present invention.

FIG. 4 shows the main body of the vacuum cleaner.

Referring to FIG. 4, the second base 150 is disposed on a rear-top portion of the first base 110. A motor housing 300 is disposed on a rear portion of the first base 110. Then, the cover 200 is coupled to the first and second bases 110 and 150 to define the main body 100.

Here, the cover 200 is coupled to the first and second bases 110 and 150 in a state where the front support 170 is coupled to the cover 200. A flowing direction of the air introduced into the motor housing 300 through the third air intake hole 172 is changed by 90° in a vertical direction and is then changed in a horizontal direction so that the air can be exhausted rearward.

Figure 5:
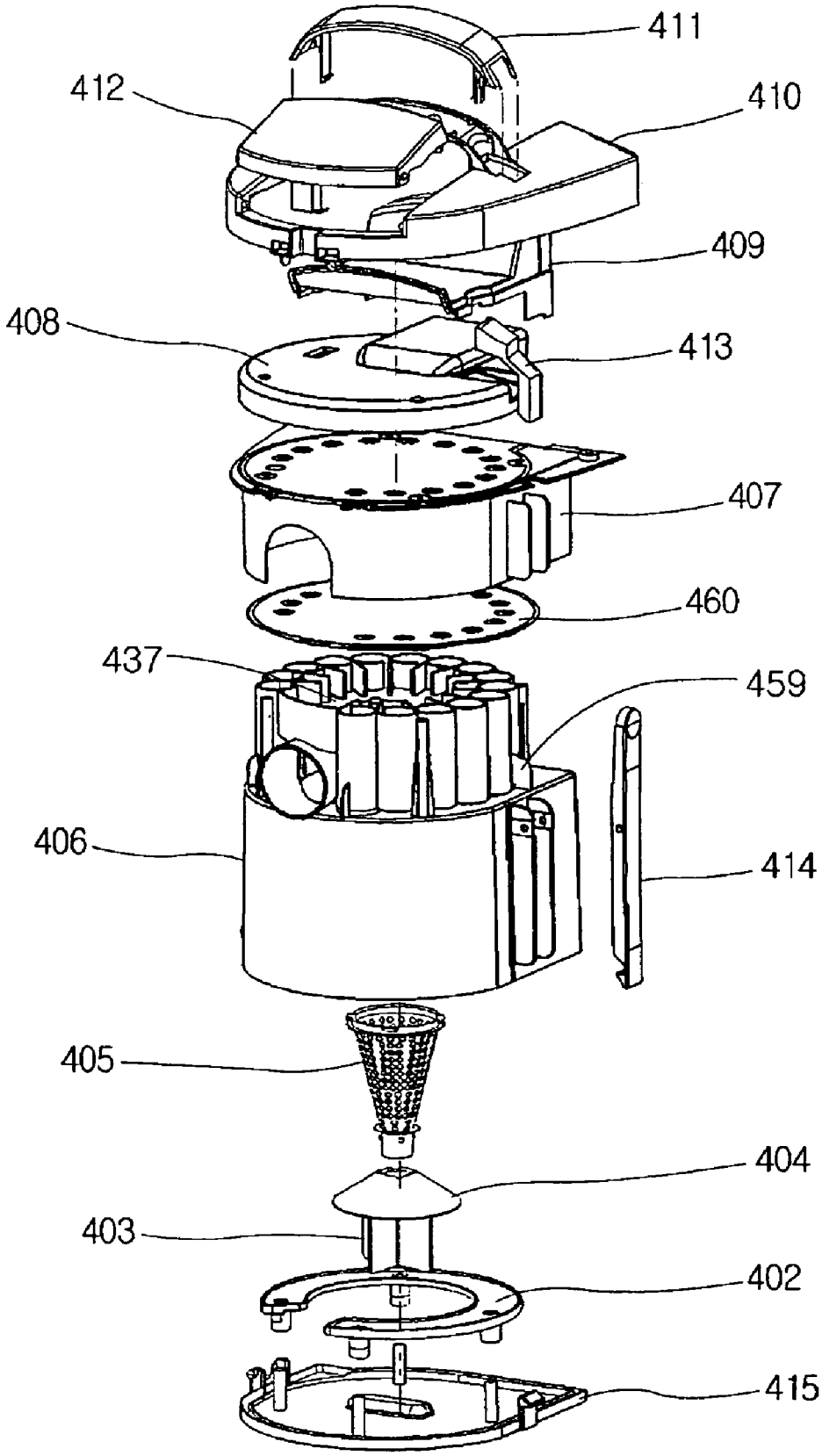
FIG. 5 is an exploded perspective view of a dust collection unit according to one embodiment of the present invention.

FIG. 5 shows the dust collection unit according to an embodiment of the present invention.

Referring to FIG. 5, the inventive dust collection unit 400 does not use a porous filter such as a sponge. That is, the inventive dust collection unit 400 is designed to filter the foreign objects using cyclone airflows. The cyclone airflow is generated at least two chambers separated from each other so that even the micro-scale dusts contained in the air can be filtered. This will be described in more detail hereinafter.

The dust collection unit 400 includes a collection body 406 provided with a plurality of filtering chambers (refer to the reference numerals 423 and 424 of FIG. 6) for filtering the foreign objects and a plurality of storing chambers (refer to the reference numerals 417 and 416 of FIG. 6) for storing the filtered foreign objects, chamber seal members 402 and 415 provided to seal a bottom of the collection body 406 and prevent the foreign objects stored in the storing chambers 416 and 417 from leaking, an air exhaust member 407 disposed on the collection body 406 to guide the flow of the air exhausted from the collection body 406, a gap forming member 408 providing a predetermined gap above the exhaust member 407 to allow the air exhausted from the exhaust member 407 to flow in a direction, and a cover assembly disposed on the gap forming member 408.

The cover assembly includes a first cover 410 functioning as a main body of the cover assembly, second and third covers 409 and 412 respectively disposed in rear and front of the first cover 410, a cover fixing member 411 fixing the first and second covers 410 and 409. The cover fixing member 411 is designed to cover a portion of the first cover 410 to improve the outer appearance while simultaneously fixing the first and second covers 410 and 409.

Disposed in the dust collection body 406 are a cone-shaped filter 405 and a blocking member 404 and airflow preventing plates 403. The cone-shaped filter 405 is provided to effectively filter the foreign objects when the cyclone airflows are generated. The blocking member 404 is disposed under the cone-shaped filter 405 to prevent the collected foreign objects from flying. The airflow preventing plates 403 are formed under the blocking member 404 to lower the airflow rate and to thereby allow the foreign objects to sink to the bottoms of the foreign object storing chambers.

The airflow preventing plates 403 and the blocking member 404 may be integrally formed with each other while the cone-shaped filter 405 may be provided as a separated part that may be fitted on the cone-shaped filter 405. Therefore, when he foreign objects are clogged in the cone-shaped filter 405, after the blocking member 404 is separated from the cone-shaped filter 405, the foreign objects clogged in the cone-shaped filter 405 are conveniently removed from the cone-shaped filter 405.

That is, when the foreign objects such as hairs or papers are sucked and adhered to an outer wall of the cone-shaped filter 405, the sucking force is remarkably weakened. In this case, the user must remove the foreign objects from the cone-shaped filter 405. At this point, the blocking member 404 is first separated from the cone-shaped filter 405 so that the user can conveniently remove the foreign objects from the cone-shaped filter 405. Since the cone-shaped filter 405 has a diameter reduced as it goes downward, the foreign objects such as the hairs can be easily removed by being simply pulled downward.

Since the second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. Therefore, at the lower portion of the first filtering chamber 423, the foreign objects may move to the central portion and passes through the apertures 426 of the filter 405. To prevent this, the filter 405 is formed in the cone-shape. In this case, the foreign objects do not pass through the apertures 426 but are collected in the first filtering chamber 423.

In addition, an opening/closing button 413 is provided on the first cover 410 and an opening/closing lever 414 having a first end contacting the opening/closing button 413 to pivot when the opening/closing button 413 is pushed. The opening/closing lever 414 has a second end contacting the first chamber seal member 415. Therefore, when the opening/closing lever 414 is pushed, the opening/closing lever 414 pivots around a predetermined hinge point. When the second end of the opening/closing lever 414 moves away from the first chamber seal member 415, the first chamber seal member 415 rotates around a hinge point by its self-gravity and the foreign objects collected in the storing chambers 416 and 417 settled by their self-gravities.

In addition, the chamber seal members 415 and 402 are designed to respectively seal the bottoms of the foreign object storing chambers 415 and 416. The first chamber seal member 415 is hinge-coupled to the collection body 406 so that it can be opened by a pivotal motion when it is intended to throw away the foreign objects stored in the first chamber seal member 415.

A separation plate 437 for separating the first and second filtering chambers 423 and 424 from each other and defining an air passage is provided on a top surface of the collection body 406.

A plurality of guide ribs 459 is formed on an outer circumference of the collection body 406 to guide the insertion of the exhaust member 407 around the collection body 406. Each of the guide ribs 459 is gently rounded at an upper corner to effectively guide the insertion.

Since outer ends of the guide ribs 459 are designed to contact an inner circumference of the exhaust member 407, even when outer impact is applied to the exhaust body 407, the outer impact can be absorbed by the guide ribs 459, thereby preventing the exhaust member 407 from being damaged or broken by the outer impact.

Figure 6:
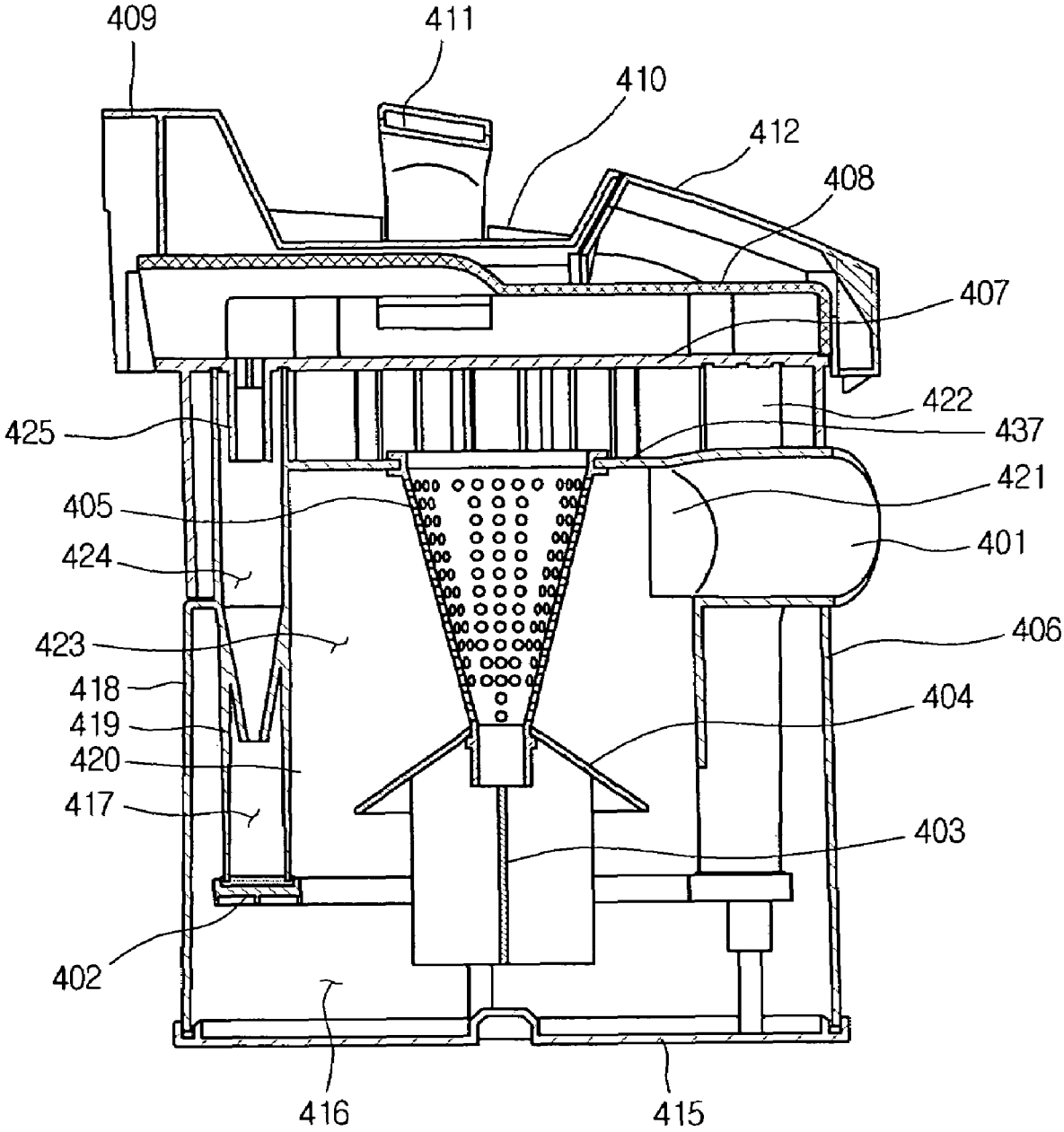
FIG. 6 is a sectional view taken along lines I-I' of FIG. 3.

The internal structure and operation of the dust collection unit 400 will be described in more detail with reference to FIG. 6.

As described with reference to FIG. 5, the dust collection unit 400 includes the collection body 406, the chamber sealing members 402 and 415 provided to selectively seal the bottom of the collection body 406, the cone-shape filter 405 received in the collection body 406 to enhance the dust collection efficiency, the blocking member 404 preventing the foreign objects stored in the collection body 406 from flying, the airflow preventing plates 403 for lowering the airflow rate and for thereby allowing the foreign objects to sink to the bottoms of the foreign object storing chambers, the air exhaust member 407 disposed on the collection body 406 to guide the flow of the air exhausted from the collection body 406, the gap forming member 408 providing a predetermined gap above the exhaust member 407 to allow the air exhausted from the exhaust member 407 to flow in a direction, and covers 409, 410, 411, and 412 disposed on the gap forming member 408.

The collection body 406 includes the outer wall 418, the intermediate wall 419 and the inner wall 420. The outer wall 418 and the intermediate wall 419 are not formed on the portion where the second air intake hole 401 is formed, thereby allowing the air to be effectively introduced.

A space defined between the outer wall 418 and the intermediate wall 419 becomes the first storing chamber 416 and a space defined between the intermediate wall 419 and the inner wall 420 becomes the second storing chamber 417. An inner space defined by the inner wall 420 becomes the first filtering chamber 423. However, the functions of the spaces vary according to the shape of the dust correction unit 400.

The operation of the above-described dust collection unit will be described hereinafter with reference to the airflow.

The air is first introduced into the dust collection unit 400 through the second air intake hole 401. Here, an outer end of the second air intake hole 401 communicates with the front support 170 and an inner end of the second air intake hole 401 communicates with the first filtering chamber 423. A first air introduction guide 421 is projected inward from a portion of the inner wall 420, which defines the inner end of the second air intake hole 401, to guide the air in an inner circumferential direction of the first filtering chamber 423.

When the cyclone airflow is generated in the first filtering chamber 423, the foreign objects contained in the air are settled and the cleaned air is exhausted upward through the apertures of the cone-shaped filter 405. The second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. This is the reason for forming the filter 405 in the cone-shape. That is, since a large amount of the foreign objects are forced outward in the relatively high RPM cyclone airflow and a large amount of the foreign objects are forced in the relatively low RPM cyclone airflow, it is preferable that the filter 405 is formed in the cone-shape.

The cone-shaped filter 405 may be detachably seated on a center of the separation plate 437 defining a top wall of the first filtering chamber 423. The cone-shaped filter 405 is typically provided with a plurality of pores through which the air passes.

The blocking member 404 is disposed under the cone-shaped filter 405 to prevent the settled foreign objects from flying. The blocking member 404 has a diameter that is increased as it goes downward to prevent the foreign objects from flying in a reverse direction. The airflow preventing plates are disposed under the blocking member 404 at a predetermined gap to prevent the cyclone airflow from reaching the settled foreign objects, thereby basically preventing the settled foreign objects from flying.

Next, a coupling relationship between the cone-shaped filter 405, the blocking member 404, and the airflow preventing plate 403 will be described hereinafter in detail.

Figure 7:
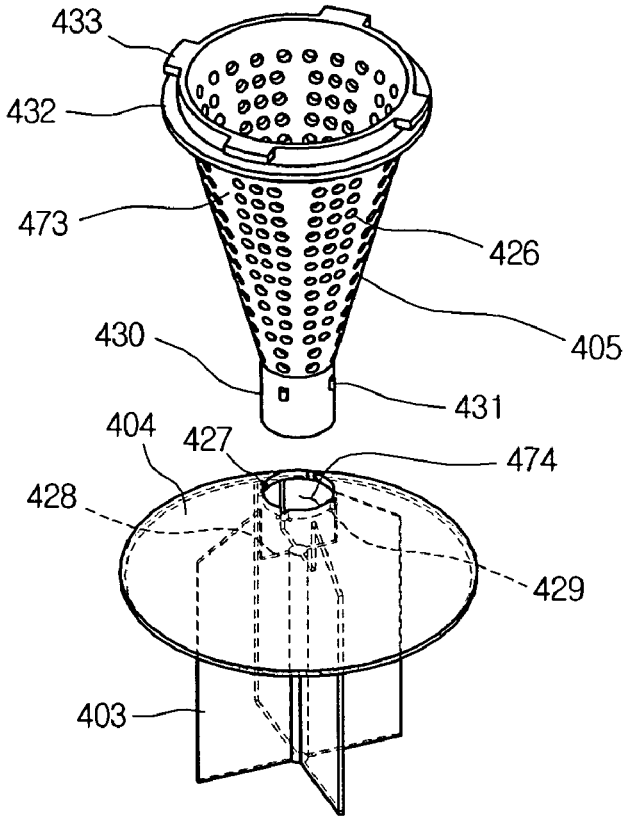
FIG. 7 is an exploded perspective view of a cone-shaped filter and a blocking member that are separated from each other.

FIG. 7 shows the cone-shaped filter and the blocking member that are separated from each other.

As shown in FIG. 7, the cone-shaped filter 405 and the blocking member 404 are individual parts. The airflow preventing plate 403 is integrally formed under the blocking member 404.

As described above, since the blocking member 404 and the cone-shaped filter 405 are formed in individual parts, when it is intended to clean the cone-shaped filter 405, the blocking member 404 is first separated from the cone-shaped filter 405. Then, the foreign objects such as hairs can be easily removed from the cone-shaped filter 405 by being simply pulled downward.

In order to easily perform the coupling and separating operation, the filter is formed in the cone shape having a diameter that is reduced as it goes downward.

That is, the cone-shaped filter 405 is provided with a plurality of apertures 426 through which the cleaned air passes. The cone-shaped filter 405 is not provided at a lower portion with the apertures 426. The lower portion not having the apertures defines an insertion portion 430, which can be inserted into the blocking member 404. The insertion portion 430 is provided with at least one first projection 431 extending outward. The projection 431 functions to fix the cone-shaped filter 405 on the blocking member 404 when the insertion portion 430 is inserted in the blocking member 404.

In order to allow the cone-shaped filter 405 to be separated from the collection body 406, the cone-shaped filter includes a circumferential seating surface 432 formed on an upper portion of the cone-shaped filter 405 and guide ribs 433 projected on an outer circumferential surface of a top of the cone-shaped filter 405 and distant from the seating surface 432. The seating surface 432 is seated on a bottom of the separation plate 437.

The blocking member 404 is provided at a top with an opening 474 in which the insertion portion 430 can be inserted. An inner circumference defining the opening 474 is provided with an insertion groove 427 in which the first projection 431 is inserted. The plurality of airflow preventing plates 403 disposed in a radial direction is integrally formed on the bottom of the blocking member 404. Upper portions of the airflow preventing plates 403 are cut away to define a receiving portion 428 in which the insertion portion 430 inserted in the blocking member 404 is received. The inner circumference defining the opening 474 is further provided with second projections 429 extending inward at both sides of the insertion groove 427.

Meanwhile, as described above, the cone-shaped filter 405 is designed in a proper shape in response to the airflow rate variation according to the inner level of the first filtering chamber 423 so as to disallow the foreign objects from passing therethrough. By providing such a cone-shaped filter 405, the foreign objects can be perfectly filtered without using any additional porous filter. Moreover, the foreign objects such as the hairs accumulated on the outer wall of the cone-shaped filter 405 can be easily removed by being simply pulled downward.

In addition, the cone-shaped filter 405 is provided throughout its entire body with the apertures 426 so that it cannot function as resistance against the airflow. That is, since the insertion portion 430 not having the apertures 426 is inserted into the blocking member without being exposed outward, it should be regarded that the cone-shaped filter is actually provided throughout its entire body with the apertures 426. Since a lower end of the cone-shaped filter 405 is substantially reduced to substantially define an acute point, it can actively respond to the airflow rate variation, thereby improving the foreign object removal efficiency.

In addition, since the blocking member 404 is formed right under the cone-shape filter 405, the air cannot pass through the blocking member 404 and the foreign objects falls down along the outer circumferential surface of the blocking member 404. The inner circumferential surface of the blocking member 404 functions to prevent the settled foreign objects from flying, thereby further improving the foreign object removal efficiency.

Figure 8:
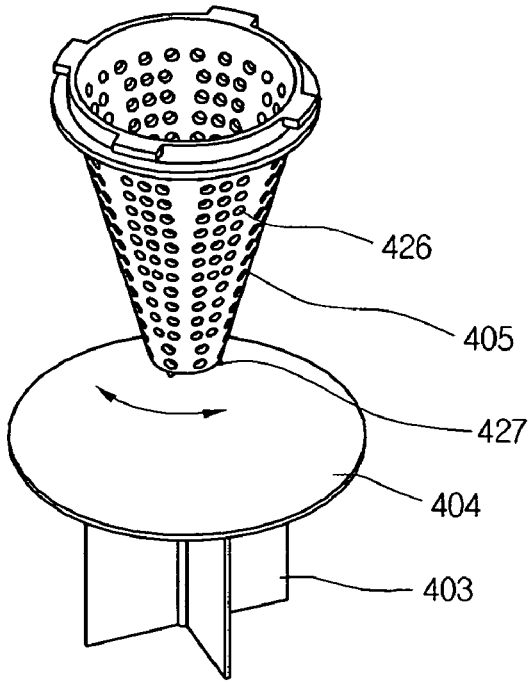
FIG. 8 is a view illustrating an assembling process of a cone-shaped filter and a blocking member.

The coupling operation of the cone-shaped filter 405 and the blocking member 404 will be described with reference to FIGS. 7 and 8.

First, the blocking member 404 is lifted in a state where the first projection 431 is aligned with the insertion groove 427. When the first projection 431 is not aligned with the insertion groove 427, the insertion portion 430 cannot be inserted. Thus, the user can easily identify the insertion location by rotating the blocking member 404 by a predetermined angle.

Then, when the insertion portion 430 is received in the receiving portion 428, the upper end of the blocking member 404 contacts the filter body 473 of the cone-shaped filter 405 and the first projection 431 contacts the second projection 429 by a slight height difference therebetween. In this state, as indicated by arrow in FIG. 8, the blocking member rotates in a direction. Then, the first projection 431 goes over the second projection 429 to realize the clear hooking action. In order to realize the hooking action regardless of the rotational direction of the blocking member 404, the second projection 429 is provided at both side locations of the insertion groove 427. In order for the first projection 431 to go over the inner circumferential surface of the blocking member 404 that is inclined outward as it goes downward, it is preferable that the upper end of the first projection 431 is inclined downward by a predetermined angle.

Figure 9:
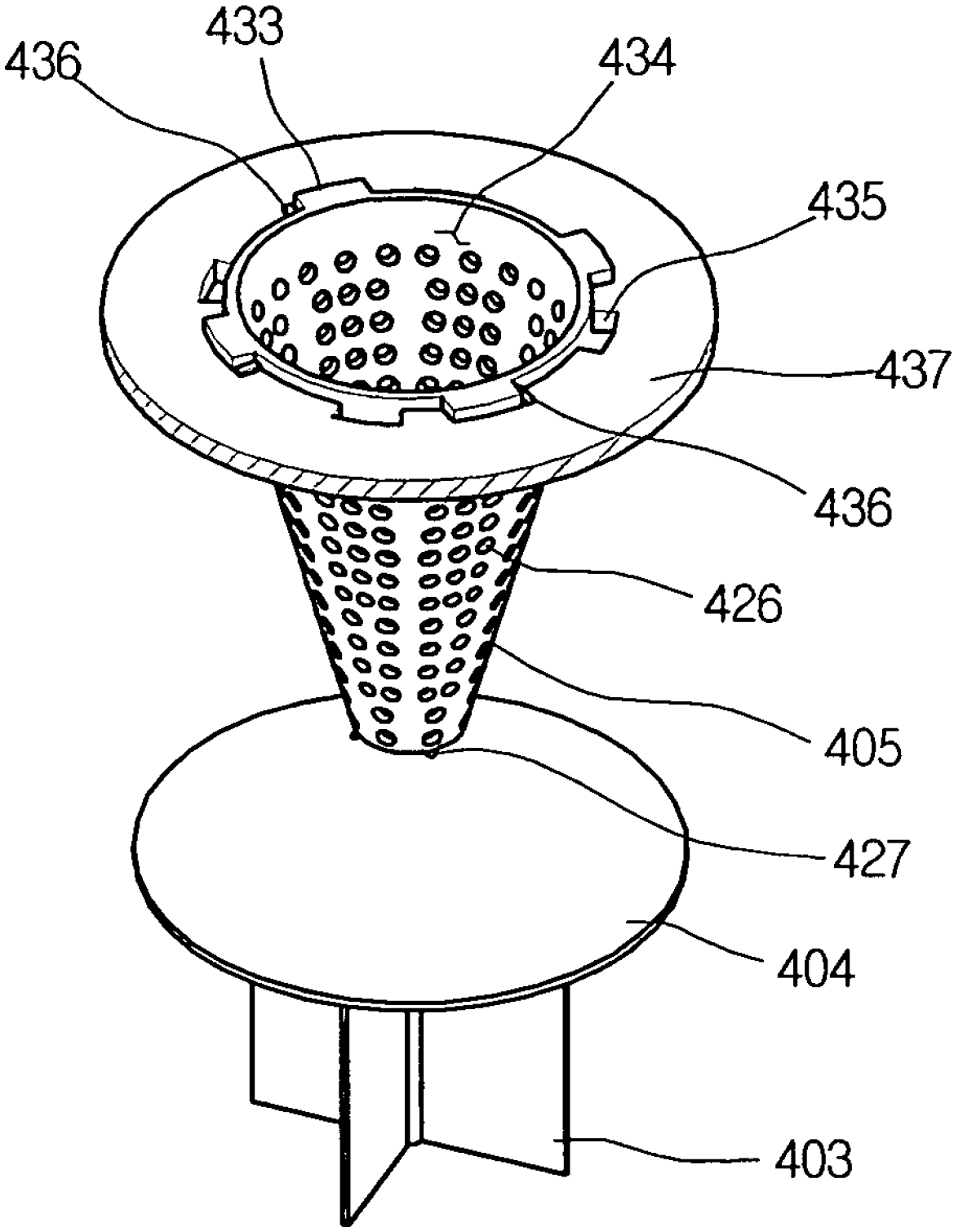
FIG. 9 is a view illustrating an assembled state of a cone-shaped filter and a blocking member.

FIG. 9 shows the coupling relationship between the cone-shaped filter and the collection body.

Referring to FIG. 9, the separation plate 437 is provided with a communication hole 434 through which the air directed from the cone-shaped filter 405 is exhausted. An inner circumference defining the communication hole 434 is provided with a plurality of rib insertion grooves 435 in which the guide ribs 433 are inserted. A third projection 436 is formed on an upper surface of the rib insertion groove 435 at a center portion of the rib insertion groove 435.

When describing the fixing operation of the cone-shaped filter 405, the guide ribs 433 and the rib insertion grooves 435 are aligned with each other by rotating the cone-shaped filter 405. Next, the cone-shaped filter 405 is lifted so that the guide ribs 433 pass through the rib insertion grooves 435. In this state, a gap between the guide ribs and the seating surface 432 is slightly less than a thickness of the separation plate 437.

Here, when the cone-shaped filter 405 rotates, the separation plate 437 is forcedly fitted into the gap between the guide ribs 433 and the seating surface 432, thereby fixing the upper end of the cone-shaped filter 405 on the separation plate 437. When the cone-shaped filter 405 further rotates, the guide rib 433 contacts the third projection 436, thereby stopping the rotation. When the cone-shaped filter 405 cannot rotate any more, the user can identify that the fitting is completed to release the force being applied for the rotation.

As described above, the cone-shaped filter 405 may be fixed on the separation plate 437 as an individual part. The blocking member 404 may be fixed on the cone-shaped filter as an individual part.

Therefore, when the user intends to clean the cone-shaped filter 405, the blocking member 404 is separated from the cone-shaped filter 405 in a state where the cone-shaped filter 405 is fixed on the separation plate 437. In this state, the cone-shaped filter 405 may be cleaned. When it is intended to clean the cone-shaped filter 405 using water, the cone-shaped filter 405 is cleaned in a state where the separation plate 437 is separated therefrom.

In the fixing process, the cone-shaped filter 405 is fixed on the separation plate 437 in a state where the blocking member 404 is separated, after which the blocking member 404 is fixed on the cone-shaped filter. If the cone-shaped filter 405 is fixed on the separation plate 437 in a state where the blocking member 404 is fixed thereon, the user cannot easily find out the location of the cone-shaped filter 405 since the user cannot see the aligned position of the guide ribs 433 and the rib insertion grooves 435 as the field of view of the user is screened by the blocking member 404. That is, this problem can be solved by fixing the cone-shaped filter 405 on the separation plate 437 in a state where the blocking member 404 is separated therefrom.

In the above-described embodiments, the structure such as the projections 431, 429 and 436 may be varied. For example, other hooking structure may be applied. Alternatively, an insertion groove may be formed on the insertion portion 430 and a projection may be formed on the blocking member 404.

Furthermore, when a relatively large airflow preventing plate 403 is required, the airflow preventing plate 403 may be formed as an individual part that can be fixed on the blocking member later.

Referring again to FIG. 6, the foreign objects filtered in the first filtering chamber 423 are stored in the first storing chamber 416 formed under the first filtering chamber 423. A bottom of the first storing chamber 416 is sealed by the first sealing member 415. The air introduced passes through the first filtering chamber 423, in the course of which the relatively large-sized foreign objects contained therein are filtered, and is then directed to the separation plate 437 through the cone-shaped filter 405. Therefore, in order to filter micro-scale foreign objects, additional cyclone airflow is further required. This will be described in more detail hereinafter.

The air passing through the cone-shaped filter 405 is introduced into the second filtering chambers 424 through a second air introduction guide 422. Since the second air introduction guide 422 faces the inner circumference of the second filtering chambers 424 in a tangent direction, the cyclone airflow is generated in the second filtering chamber 424.

The foreign objects filtered in the second filtering chambers 424 by the cyclone airflow are settled in the second storing chamber 417. In order to prevent the settle foreign objects from flying, a width of each of the lower portion of the second filtering chambers 417 are narrowed. In addition, in order to prevent the settled foreign objects from leaking, a bottom of the second storing chamber 417 is sealed by the second chamber sealing member 402.

The second chamber sealing member 402 has a bar-shaped connection structure to be connected to the first chamber sealing member 415, thereby increasing an inner volume of the first storing chamber 416. That is, since the foreign objects are stored in the space defined between the lower end of the second chamber sealing member 402 and the upper end of the first chamber sealing member 415, it is preferable that the connection structure is formed in a bar-shape that can occupy a small space.

The air whose foreign objects are filtered in the second filtering chamber 424 is introduced into the exhaust member 407 via an exhaust side air intake hole 425 and collected in a space between the exhaust member 407 and the gap forming member 408. Here, a diameter of the exhaust side air intake hole 425 is less than an inner diameter of the second filtering chamber 424 so as to prevent the foreign objects in the second filtering chamber 424 from being directed to the exhaust member 407. That is, the foreign objects collected on the inner circumference of the second filtering chambers 424 are not exhausted through the exhaust side air intake hole 425.

The air whose foreign objects are filtered in the first and second filtering chambers 423 and 424 by the cyclone airflows is directed to the motor and then exhausted through the rear surface of the main body 100.

Meanwhile, the cover assembly is further formed on an upper portion of the gap forming member 408. The cover assembly includes the first cover 410, the second and third covers 409 and 412 covering the rear and front portions of the fist cover 410, and the cover fixing member 411 fixing the second cover 409 to the first cover 410.

The operation of the above-described dust collection unit 400 and the overall operation of the main body 100 of the vacuum cleaner will be described hereinafter with reference to FIG. 10.

Figure 10:
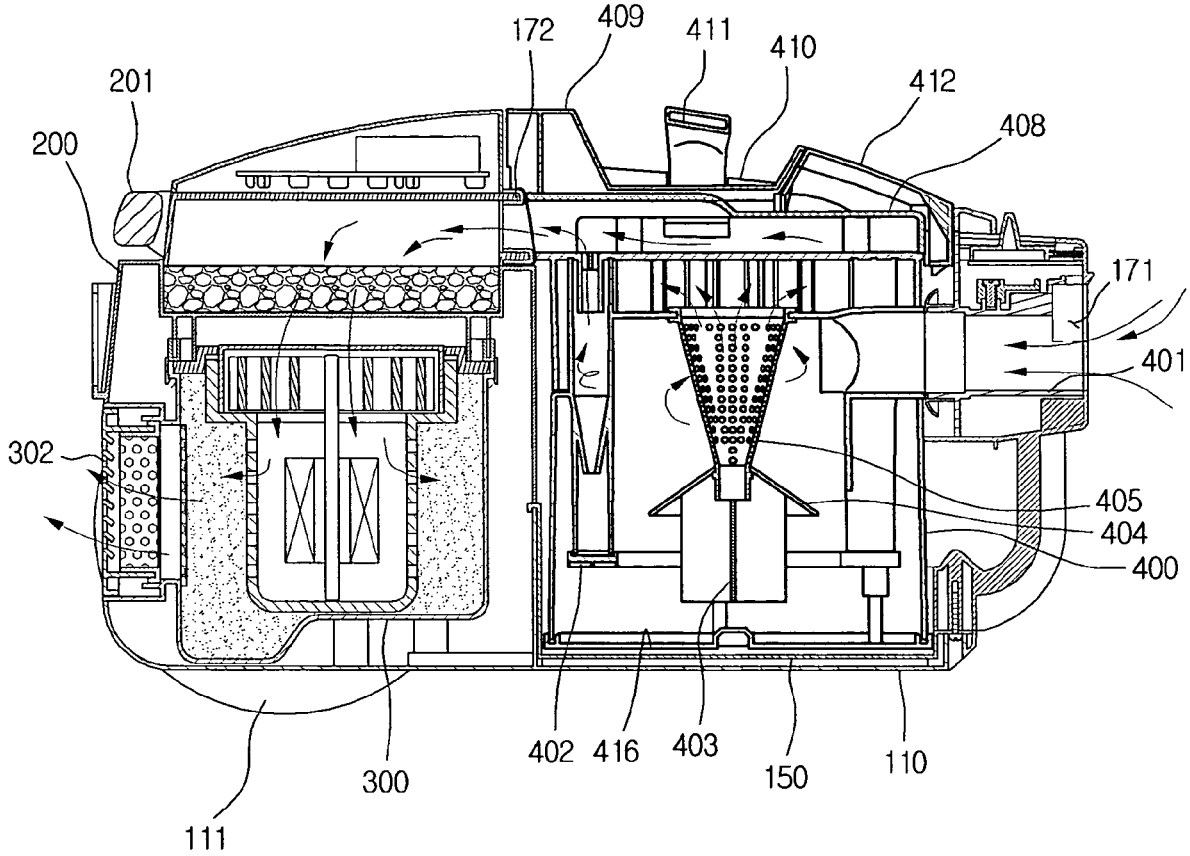
FIG. 10 is a longitudinal sectional view of a vacuum cleaner where a dust collection unit of the present invention is applied.

Referring to FIG. 10, outer air is introduced into the main body 100 through the air intake hole 171 of the main body 100 and is then introduced into the dust collection unit 400 through the air intake hole of the dust collection unit. The foreign objects contained in the air is filtered in the dust collection unit 400 as described above and is then introduced into the motor housing 300 in a horizontal direction.

The air introduced into the motor housing 300 in the horizontal direction moves downward to be exhausted through the exhaust holes 302 formed on the rear surface of the main body 100.

According to a feature of the present invention, a variety of cyclone devices are provided to completely filter even the micro-scale dusts without using a porous filter. Particularly, the cone-shaped filter is provided in the filtering chamber having a relatively large diameter so that relatively large foreign objects can be effectively removed by the cone-shaped filter.

In addition, the parts such as the filter received in the dust collection unit can be conveniently disassembled and assembled.

The application of the inventive dust collection unit is not limited to the canister type vacuum cleaner described in the embodiments. That is, the inventive dust collection unit may be applied to other types of vacuum cleaners such as an upright type vacuum cleaner.

It will be apparent to those skilled in the art that various modifications and variations can be made in the present invention. Thus, it is intended that the present invention covers the modifications and variations of this invention provided they come within the scope of the appended claims and their equivalents.

According to the present invention, by providing a variety of cyclone devices, the foreign object removal efficiency can be improved.

In addition, by providing a cone-shaped filter that is properly designed in response to the cyclone airflow states, the dust collection efficiency can be improved and the convenience for the user can be improved. In addition, since a plurality of apertures are formed on an entire body of the cone-shaped filter, the resistance against the airflow can be reduced.

Furthermore, since the blocking member is provided right under the cone-shaped filter, the foreign objects can quickly fall down and the fly of the settled foreign objects can be prevented.

In addition, since the cone-shaped filter is designed to be separable from the collection body and from the blocking member, the cleaning of the cone-shaped filter can be conveniently processed. Furthermore, since the blocking member is integrally formed with the airflow preventing plate, the structure can be simplified.

What is claimed is:

1. A dust collection unit for a vacuum cleaner, comprising:
- a first filtering chamber filtering foreign objects using a cyclone airflow;
- a separation plate defining a top surface of the first filtering chamber;
- a filter disposed in the first filtering chamber; and
- a blocking member detachably mounted under the filter to prevent the foreign objects filtered in the first filtering chamber from flying,
- wherein the filter is provided at a lower end portion with an insertion portion that can be at least partly inserted into the blocking member.

2. The dust collection unit according to claim 1, wherein the diameter of the blocking member increases in a direction extending away from the filter.

3. The dust collection unit according to claim 1, wherein the filter is coupled to the separation plate to be capable of separating from the separation plate.

4. The dust collection unit according to claim 1, wherein a lower end of the filter is formed to define an acute point.

5. The dust collection unit according to claim 1, wherein the filter is provided throughout its entire body with apertures.

6. The dust collection unit according to claim 1, wherein the filter is formed in a cone shape.

7. The dust collection unit according to claim 1, wherein the separation plate is provided with a communication hole through which air passed through the filter flows.

8. The dust collection unit according to claim 1, wherein the filter is designed to be separable from the separation plate.

9. The dust collection unit according to claim 1, further comprising:
- an insertion groove formed on the blocking member to correspond to the insertion portion; and
- a second projection formed on the insertion groove to interlock with the insertion portion.

10. The dust collection unit according to claim 1, further comprising an airflow preventing plate integrally formed on a bottom of the blocking member.

11. The vacuum cleaner according to claim 10, wherein the filter is formed in a cone shape.

12. A vacuum cleaner comprising:
- a base;
- a dust collection unit disposed on a front portion of the base;
- a motor disposed on a rear portion of the base; and
- a cover disposed above the base,
- wherein the dust collection unit comprises:
  - a first filtering chamber;
  - a plurality of second filtering chambers formed on an outer circumference of the first filtering chamber;
  - storing chambers formed under the first and second filtering chambers;

a filter detachably mounted on a center portion of the first filtering chamber, the filter being formed of a rigid plastic material;

a blocking member detachably mounted on the filter; and a plurality of airflow preventing plates disposed in a radial direction and integrally formed with a bottom surface of the blocking member.

13. The vacuum cleaner according to claim 12, wherein an upper end of the filter is hooked on a top surface of the first filtering chamber.

14. The vacuum cleaner according to claim 12, wherein the blocking member has a circular horizontal section and the filter is fixed in a state where at least a portion of the filter is inserted in the blocking member.

15. The vacuum cleaner according to claim 12, wherein the filter, the blocking member and the airflow preventing member are aligned in a vertical direction.

16. The vacuum cleaner according to claim 12, wherein the filter is provided throughout its entire body with apertures.

17. A vacuum cleaner comprising:

a base;

a dust collection unit disposed on a front portion of the base;

a motor disposed on a rear portion of the base;

a cover disposed above the base; and wherein the dust collection unit comprises:

a filtering chamber, a filter detachably mounted on a center portion of the first filtering chamber, the filter being formed of a rigid plastic material;

a blocking member detachably mounted on the filter; and a plurality of airflow preventing plates disposed in a radial direction and integrally formed with a bottom surface of the blocking member.

18. A vacuum cleaner comprising:

a motor generating sucking force;

a dust collection unit filtering foreign objects contained in air introduced by the sucking force generated by the motor; and a suction assembly guiding outer air to the dust collection unit, wherein the dust collection unit comprises:

a first filtering chamber formed on a center portion of the dust collection unit and having a relatively large diameter;

a plurality of second filtering chambers formed on an outer circumference of the first filtering chamber;

a cone-shaped filter mounted on a center portion of the first filtering chamber;

a blocking member detachably mounted on the cone-shaped filter to prevent the foreign objects from flying; and an airflow preventing plate integrally formed with the blocking member to stop the cyclone airflow.

* * * * *